US005830248A

United States Patent [19]

Christianson et al.

[11] Patent Number: 5,830,248

[45] Date of Patent: Nov. 3, 1998

[54] METHOD FOR MAKING A SPLICELESS COATED ABRASIVE BELT

[75] Inventors: Todd J. Christianson, Oakdale; Harold W. Benedict, Cottage Grove, both of Minn.

[73] Assignee: Minnesota Mining & Manufacturing Company, St. Paul, Minn.

[21] Appl. No.: 752,996

[22] Filed: Nov. 21, 1996

Related U.S. Application Data

[63] Continuation of Ser. No. 513,325, Aug. 10, 1995, Pat. No. 5,578,096.

[51] Int. Cl.[6] ..... B24D 11/00

[52] U.S. Cl. ..... 51/295; 51/293; 156/137; 156/143

[58] Field of Search ..... 51/295, 297, 298, 51/293; 156/137, 143

[56] References Cited

U.S. PATENT DOCUMENTS

| | | | |
|---|---|---|---|
| Re. 25,587 | 6/1964 | Wiltshire | 264/114 |
| 289,879 | 12/1883 | Almond | 451/524 |
| 1,412,309 | 4/1922 | Lambert | 156/137 |
| 1,676,845 | 7/1928 | Teisher | 474/271 |
| 1,924,355 | 8/1933 | Freedlander | 154/4 |
| 2,032,356 | 3/1936 | Ellis | 51/278 |
| 2,209,074 | 7/1940 | Dahlstrom | 51/188 |
| 2,333,035 | 10/1943 | Oglesby | 51/185 |
| 2,349,365 | 5/1944 | Martin et al. | 51/197 |
| 2,356,249 | 8/1944 | Kremer et al. | 154/4 |
| 2,356,866 | 8/1944 | Melton et al. | 51/293 |
| 2,391,731 | 12/1945 | Miller et al. | 51/188 |
| 2,404,207 | 7/1946 | Ball | 51/188 |

(List continued on next page.)

FOREIGN PATENT DOCUMENTS

| | | | |
|---|---|---|---|
| 1023563 | 1/1978 | Canada . | |
| 095055 | 11/1983 | European Pat. Off. | B24D 11/00 |
| 142140 | 5/1985 | European Pat. Off. | B24D 11/06 |
| 213353 | 3/1987 | European Pat. Off. | B24D 11/06 |
| 0 257 757 A3 | 3/1988 | European Pat. Off. . | |
| 321959 | 6/1989 | European Pat. Off. | D04H 1/56 |
| 333909 | 9/1989 | European Pat. Off. | B65G 15/34 |
| 340982 | 11/1989 | European Pat. Off. | D01F 8/04 |
| 349466 | 1/1990 | European Pat. Off. | B29C 41/04 |
| 451944 | 10/1991 | European Pat. Off. | B24D 3/28 |
| 533482 | 3/1993 | European Pat. Off. | G03G 15/00 |
| 626238 | 11/1994 | European Pat. Off. | B24D 11/06 |

(List continued on next page.)

OTHER PUBLICATIONS

"Air Products Announces Trademark Changes for Polyurethane Prepolymers and Curatives", News Release #94034 from Air Products & Chemicals, Inc., 2 pgs (Jan. 3, 1994).

"American National Standard for Grading of Certain Abrasive Grain on Coated Abrasive Material", sponsored by Grinding Wheel Institute (ANSI Standard B74.18–1984), 32 pages (Jan. 27, 1984).

"Standard Test Methods for Impact Resistance of Plastics and Electrical Insulating Materials", ASTM Designation: D256–84, 81–102 (Sep. 1984).

"Standard Test Methods for Impact Resistance of Rigid Plastic Sheeting or Parts by Means of a TUP (Falling Weight)", ASTM Designation: D3029–84, 749–764 (Sep. 1984).

(List continued on next page.)

*Primary Examiner*—Deborah Jones
*Attorney, Agent, or Firm*—Richard Francis

[57] ABSTRACT

A method of making a coated abrasive article and the product thereof, involving the steps of: providing an endless spliceless backing loop substrate; applying fibrous reinforcing material onto a major surface of the endless backing substrate by applying of a first binder precursor to the fibrous reinforcing material such that the first binder precursor bonds the fibrous reinforcing material to the endless backing substrate to form a reinforcing fiber layer; further solidifying the first binder precursor; and forming an abrasive coating on the surface of one of the fiber reinforcing layer, or alternatively, the exposed surface of the backing substrate.

33 Claims, 1 Drawing Sheet

U.S. PATENT DOCUMENTS

| | | | |
|---|---|---|---|
| 2,411,724 | 11/1946 | Hill | 51/293 |
| 2,468,853 | 5/1949 | Williamson | 51/294 |
| 2,590,697 | 3/1952 | Grove | 51/297 |
| 2,682,733 | 7/1954 | Buckner | 51/188 |
| 2,704,735 | 3/1955 | Hedges et al. | 154/120 |
| 2,712,987 | 7/1955 | Storrs et al. | 51/293 |
| 2,743,559 | 5/1956 | Ball et al. | 51/183 |
| 2,773,540 | 12/1956 | Waugh | 154/4 |
| 2,785,442 | 3/1957 | Boggs | 18/58.3 |
| 2,983,637 | 5/1961 | Schmidt | 154/52.1 |
| 2,995,176 | 8/1961 | Waugh | 154/4 |
| 2,999,780 | 9/1961 | Perrault | 154/83 |
| 3,030,743 | 4/1962 | Raymond | 51/207 |
| 3,166,388 | 1/1965 | Riegger et al. | 51/196 |
| 3,276,852 | 10/1966 | Lemelson | 51/298 |
| 3,333,372 | 8/1967 | Gianatasio | 51/399 |
| 3,561,938 | 2/1971 | Block et al. | 51/358 |
| 3,562,968 | 2/1971 | Johnson et al. | 51/389 |
| 3,577,872 | 5/1971 | Drummond | 57/35 |
| 3,607,502 | 9/1971 | Marzocchi et al. | 156/142 |
| 3,729,873 | 5/1973 | Sandell | 51/399 |
| 3,860,400 | 1/1975 | Prowse et al. | 51/295 |
| 3,900,355 | 8/1975 | Goto et al. | 156/74 |
| 4,018,574 | 4/1977 | Dyer | 51/295 |
| 4,049,767 | 9/1977 | Vaidya | 264/257 |
| 4,163,647 | 8/1979 | Swiatek | 51/295 |
| 4,215,516 | 8/1980 | Huschle et al. | 51/399 |
| 4,253,836 | 3/1981 | Miranti, Jr. | 474/200 |
| 4,256,467 | 3/1981 | Gorsuch | 51/295 |
| 4,282,011 | 8/1981 | Terpay | 51/298 |
| 4,289,168 | 9/1981 | Lecourt et al. | 138/109 |
| 4,314,827 | 2/1982 | Leitheiser et al. | 51/298 |
| 4,373,933 | 2/1983 | Grazen | 51/309 |
| 4,394,340 | 7/1983 | Tarumi et al. | 264/219 |
| 4,455,343 | 6/1984 | Temple | 428/285 |
| 4,525,177 | 6/1985 | Grimes et al. | 51/295 |
| 4,554,765 | 11/1985 | Grimes et al. | 51/401 |
| 4,588,419 | 5/1986 | Caul et al. | 51/295 |
| 4,609,581 | 9/1986 | Ott et al. | 428/100 |
| 4,652,274 | 3/1987 | Boettcher et al. | 51/298 |
| 4,652,275 | 3/1987 | Bloecher et al. | 51/298 |
| 4,653,236 | 3/1987 | Grimes et al. | 51/401 |
| 4,681,558 | 7/1987 | Rausch | 474/205 |
| 4,734,104 | 3/1988 | Broberg | 51/295 |
| 4,736,549 | 4/1988 | Toillie | 51/399 |
| 4,744,802 | 5/1988 | Schwabel | 51/309 |
| 4,770,671 | 9/1988 | Monroe et al. | 51/293 |
| 4,799,939 | 1/1989 | Bloecher et al. | 51/293 |
| 4,867,760 | 9/1989 | Yarbrough | 51/298 |
| 4,881,951 | 11/1989 | Wood et al. | 51/309 |
| 4,894,280 | 1/1990 | Guthrie et al. | 428/224 |
| 4,903,440 | 2/1990 | Larson et al. | 51/298 |
| 4,906,523 | 3/1990 | Bilkadi et al. | 428/327 |
| 4,960,442 | 10/1990 | Wagner et al. | 51/295 |
| 5,011,508 | 4/1991 | Wald et al. | 51/293 |
| 5,078,753 | 1/1992 | Broberg et al. | 51/298 |
| 5,108,462 | 4/1992 | Habeeb et al. | 44/383 |
| 5,108,463 | 4/1992 | Buchanan | 51/295 |
| 5,109,638 | 5/1992 | Kime, Jr. | 51/401 |
| 5,137,542 | 8/1992 | Buchanan et al. | 51/295 |
| 5,203,884 | 4/1993 | Buchanan et al. | 51/295 |
| 5,219,505 | 6/1993 | Kaiser | 264/138 |
| 5,236,472 | 8/1993 | Kirk et al. | 51/298 |
| 5,316,812 | 5/1994 | Stout et al. | 428/64 |
| 5,341,609 | 8/1994 | Gorsuch et al. | 51/399 |
| 5,344,688 | 9/1994 | Peterson et al. | 428/102 |
| 5,420,015 | 5/1995 | Wuerch | 106/162 |
| 5,436,063 | 7/1995 | Follett et al. | 428/224 |
| 5,573,619 | 11/1996 | Benedict et al. | 156/137 |
| 5,578,096 | 11/1996 | Christianson et al. | 51/295 |
| 5,584,897 | 12/1996 | Christianson et al. | 51/295 |
| 5,609,706 | 3/1997 | Benedict et al. | 156/137 |

FOREIGN PATENT DOCUMENTS

| | | | |
|---|---|---|---|
| 2095185 | 2/1972 | France | B24D 3/00 |
| 2250049 | 5/1975 | France | F16G 3/10 |
| 2396625 | 2/1979 | France | B24D 11/00 |
| 26 57 881 | 6/1978 | Germany | B24D 3/28 |
| 1240289 | 7/1971 | United Kingdom | B44D 11/00 |
| 1445520 | 8/1976 | United Kingdom | B24D 17/00 |
| 1475986 | 6/1977 | United Kingdom | B24D 11/02 |
| 1492789 | 11/1977 | United Kingdom | C09J 5/00 |
| 2 232 636 | 12/1990 | United Kingdom . | |
| 2240736 | 8/1991 | United Kingdom | B24D 3/00 |
| 86/02306 | 4/1986 | WIPO | B24D 11/02 |
| 93/02837 | 2/1993 | WIPO | B24D 3/00 |
| 93/12911 | 7/1993 | WIPO | B24D 11/00 |
| 93/24279 | 12/1993 | WIPO | B24D 3/34 |
| 95/00294 | 1/1995 | WIPO | B24D 11/00 |
| 95/11111 | 4/1995 | WIPO | B24D 3/28 |
| 95/22434 | 8/1995 | WIPO | B24D 3/28 |
| 95/22438 | 8/1995 | WIPO | B24D 11/02 |

OTHER PUBLICATIONS

"Standard Test Methods for Flexural Properties of Unreinforced and Reinforced Plastics and Electrical Insulating Materials", ASTM Designation: D790–86, 384–397 (1986).

B.F. Goodrich Specialty Polymers & Chemicals Division, "Product Data HYCAR Reactive Liquid Polymers" Brochure dated Apr. 1991 (5 pages).

Henkel Polymers Division, "Epoxy Curing Agents Products Data Sheet for Genamid 747", Identified as P–182 (undated)(2 pages).

"Material Safety Data Sheet—Polytetramethyleneoxide–di–p–aminobenzoate", Polarid Corporation, No. RCC–209 R–2, 4 pgs (Jan. 1984).

*ME,* Nov. 1990 (2 pages).

"NeoRez and NeoPac Water–borne Urethanes for Coatings Applications", ICI Resins US, 3 pgs (undated).

"Product Information—Blendur P 120M", Mobay Corporation, 3 pgs (undated).

Product Information from Air Products & Chemicals, Inc. regarding Durathane™, 1 pg (Jan. 3, 1994).

Shell, "Material Safety Data Sheet", 1 pg (Jun. 13, 1995).

*The Nonwoven Handbook*; B.M. Lichstein., Ed.; Association of the Nonwoven Fabrics Industry: New York (1988)—Title page, copyright page, and table of contents only.

"Witcond® W–290H, Wicobond W–293", Witco Corporation, Organics Division, Bulletin 345, 4 pgs (Apr. 1986).

METHOD FOR MAKING A SPLICELESS COATED ABRASIVE BELT

This a continuation of application Ser. No. 08/513,325, filed on Aug. 10, 1995 now US Pat. No. 5,578,096.

BACKGROUND OF THE INVENTION

1. Field of the Invention

The present invention pertains to a method for making a spliceless coated abrasive belt reinforced by a continuous elongate fibrous material, and the product of this method.

2. Related Art

Coated abrasive articles generally contain an abrasive material, typically in the form of abrasive grains, bonded to a backing by means of one or more adhesive layers. Such articles usually take the form of substrates, discs, belts, bands, and the like, which can be adapted to be mounted on pulleys, wheels, or drums. Abrasive articles can be used for sanding, grinding, or polishing various surfaces of, for example, steel and other metals, wood, wood-like laminates, plastic, fiberglass, leather, or ceramics.

The backings used in coated abrasive articles are typically made of paper, polymeric materials, cloth, nonwoven materials, vulcanized fiber, or combinations of these materials. Many of these materials alone provide unacceptable backings for certain applications because they are not of sufficient strength, flexibility, or impact resistance. As a result, early failure and poor functioning can occur, at least in certain applications of these backing materials in a nonreinforced state.

In a typical manufacturing process, a coated abrasive article, including the backing and abrasive coating, among other things, is made in a continuous web form and thereafter converted into a desired construction, such as a substrate, disc, belt, or the like. One of the most useful constructions of a coated abrasive article is an endless coated abrasive belt, i.e., a continuous loop of coated abrasive material. In order to form such an endless belt, the web form is typically cut into an elongate strip of a desired width and length. The ends of the elongate strip of the preformed substrate of coated abrasive article are then joined together to create a "joint" or a "splice".

There are two commons ways to join the free ends of an elongate strip to make a spliced endless belt. These are respectively referred to as a "lap" splice or a "butt" splice. In a "lap" splice, the two free ends of the elongate strip are respectively beveled to have a top end and a bottom end which can be superposed to form a joint without causing a significant change in the overall thickness of the belt. The beveling on what will become the bottom end is typically accomplished by removing abrasive grains and material from the abrasive surface of one end of the strip and removing part of the material from the backing or underside of the other end of the strip to provide what will become the top end of the splice. The beveled ends are then overlapped and joined adhesively or mechanically.

For the "butt" splice, the two free mating ends of the elongate strip are brought into a juxtaposed relationship at a juncture line. The bottom surface of the backing at each end of the elongate strip, such as a preformed substrate of coated abrasive article, typically is then coated with an adhesive, mechanically secured, or otherwise attached, and maybe overlaid with a strong, thin, tear-resistant, splicing media in the joint area.

Lap and butt splices, while providing a satisfactory belt for many applications, may be undesirable for other applications because they typically create a discontinuity in the abrasive coating layer at the outer surface, i.e., the abrasive coating surface, of the splice site. This type of splice is generally exemplified in U.S. Pat. Nos. 2,391,731 (Miller), 3,333,372 (Gianatsio) and 4,736,549 (Toillie). A discontinuity in a coated abrasive can cause an undesirable mark in the surface of a workpiece being finished. These marks are often referred to as "chatter".

Other background art includes:

U.S. Pat. No. 289,879 (Almond) pertains to a polishing tool comprising abrasive grains adhered to a tubular backing.

U.S. Pat. No. 2,012,356 (Ellis) discloses a coated abrasive having a seamless tubular fabric backing.

U.S. Pat. No, 2,404,207 (Ball) pertains to a seamless coated abrasive article having a fibrous nonwoven backing. The fibrous nonwoven backing can be saturated with an adhesive and contain other reinforcing fibers.

U.S. Pat. No. 2,411,724 (Hill) teaches a method for making an endless tubular coated abrasive, wherein a thermoplastic or thermosetting adhesive is extruded to form a backing, in which abrasive grains are embedded while the backing is molten. In another embodiment of that invention, the backing can comprise a liner of reinforcing strands over which is coated the thermoplastic adhesive.

French Patent Application Publication No. 2,396,625 published 2 Feb. 1979 teaches a seamless endless coated abrasive belt that is made by the continuous weaving of a cloth backing. This reference also describes a spliced backing having a sinusoidal splice.

French Patent Publication 2,095,185 published 2 Nov. 1972 (Ponthelet) discloses an abrasive product having a nonwoven backing which may be reinforced with filaments placed in either the transversal direction, longitudinal direction or as a grid form. Where the filaments are arranged only in one direction, the filaments are said to be maintained in a parallel arrangement as held down by a veil made of natural, artificial or synthetic fibers.

PCT Published Patent Application No. WO 93/12911 (Benedict et al.) published 8 Jul. 1993 and owned by the present assignee, pertains to a method of making a spliceless coated abrasive belt having a backing which includes between about 40 to 99% by weight of an organic polymeric binder and an effective amount of a fibrous reinforcing material engulfed within the organic polymeric binder material. This reference described preparing a loop of liquid binder material having fibrous reinforcing material therein around the periphery of a drum, and then solidifying the binder material to form the endless, spliceless belt.

In many abrading applications, it is desired to use an endless coated abrasive belt that has a backing with certain desired physical properties. These properties include relatively low stretch, relatively high tensile strength value and relatively high adhesion between the backing and the abrasive coating. Although Benedict et al. represent a significant advance in the art of making coated abrasive belts, alternate approaches to improve the physical properties of the backing continue to be sought.

PCT Published Patent Application No. WO 95/00294 published 5 Jan. 1995 (Schneider et al.) and owned by the present assignee, pertains to a method of making an endless, spliceless belt. A flowable organic material is spin casted to form an uncured endless loop of organic material. Abrasive particles are then inserted into the spin caster, spun therein until they are engulfed into the organic material which is then solidified to form an endless, spliceless abrasive belt.

U.S. Pat. No. 2,349,365 (Martin et al.) involves a flexible coated abrasive article in which the backing comprises a substrate of plastic material reinforced with a substrate of cloth or paper.

PCT Published Patent Application No. WO 86/02306 publication published 24 Apr. 1986 (Hansen et al.) pertains to an improved coated abrasive backing having a flexible substrate and a multiplicity of weft free, closely spaced, stretch resistant, longitudinally aligned, coplanar, continuous filament reinforcing yarns bonded to one surface of the flexible substrate before the backing is seamed into an endless belt. Each filament of the plurality of yarns would have ends which must be joined to provide the backing substrate, providing a discontinuity and probable weak area in the backing.

U.S. application U.S. Ser. No 08/199,835 (Christianson et al.) filed 22 Feb. 1994 and assigned to the present assignee, pertains to a endless, spliced abrasive backing having reinforcing fibers.

PCT Published Patent Application No. WO 93/02837 (Luedeke et al.) published 18 Feb. 1993 and assigned to the present assignee teaches the dressing and truing of coated abrasive belts.

U.S. application U.S. Ser. No. 08/199,679 (Benedict et al.) filed 22 Feb. 1994 and assigned to the present assignee teaches a method of making an endless reinforced abrasive article comprising a sheet substrate, reinforcing fibrous material, and a binder which bonds the fibrous material to the substrate which also doubles as a make coat for adhering abrasive grain to the substrate.

Users of spliceless coated abrasive belts continue to seek stronger, more durable coated abrasive belts which are substantially free of surface and/or thickness irregularities.

SUMMARY OF THE INVENTION

The present invention pertains to a method for making a spliceless coated abrasive belt having a backing loop substrate reinforced by a continuous unspliced fibrous strand or strip material, and the product of this method.

In one embodiment, the invention pertains to a method of making a flexible coated abrasive belt comprising the steps of:

(a) mounting an endless, spliceless backing loop substrate having front and back surfaces with the back surface tautly deployed on a peripheral surface of a temporary support structure;

(b) applying a continuous fibrous reinforcing material onto the front surface of the substrate in a plurality of revolutions around the loop substrate;

(c) applying a coating of a first binder precursor onto the front surface of the loop substrate;

(d) exposing the coating to conditions effective to solidify the first binder precursor and bond to the front surface the applied fibrous reinforcing material in a reinforcing layer having an exposed surface of solidified first binder precursor material to form an endless spliceless reinforced backing; and (e) applying an abrasive coating comprising adhesive and abrasive particles over the back surface or the reinforced front surface of the endless spliceless reinforced backing.

The various steps shown in the method described above need not follow the sequence shown. It is to be understood that the application of the abrasive coating to a surface of the backing substrate may precede the step of applying the fibrous reinforcing material to the opposite surface of the backing substrate. Also, the step of applying the abrasive coating may be accomplished by applying a preformed abrasive coating which is formed in situ on either of the fiber reinforcing layer or the exposed surface backing substrate, or the abrasive coating may be applied by laminating a preform thereof on either one of such surfaces.

It is also within the scope of this invention to apply the binder precursor to the fibrous reinforcing material before, simultaneous to, or after the applying of the fibrous reinforcing material to a surface of the spliceless loop of backing substrate. It further is within the scope of the invention to use more than one binder precursor to apply the fibrous reinforcing material to the backing substrate, such as by applying binder to the fibrous reinforcing material and the surface of the backing substrate to be contacted with same.

It is further within the scope of this invention to apply several layers of fibrous reinforcing material to the spliceless backing substrate. These layers may be formed of the same or different reinforcing materials. Additionally, a single reinforcing layer may comprise several different reinforcing materials.

For purposes of this invention, the term "endless, spliceless" in describing the backing substrate means that the backing substrate used in the belt has no free ends along its length direction; i.e., it is a closed loop. The endless spliceless backing loop substrate is preferably formed prior to installation on the support structure.

For purposes of this invention, the fibrous reinforcing material is applied to the spliceless backing loop substrate in a "continuous" manner in the sense that it is constituted by at least one individual fibrous strand or narrow fibrous strip wrapped around the endless spliceless backing loop substrate more than one complete revolution of the fibrous reinforcing material along the entire machine direction length of the loop.

The coated abrasive belts of the present invention are characterized by having one or more of the following improved properties. The endless spliceless substrate loop provides a backing which is free of any high areas or splice marks. The fiber reinforcement of the abrasive belt endows the abrasive belts of the invention with a greater resistance to stretch and an increased tensile strength and improved useful life. Obviously, the actual magnitude of improvement of these properties will depend in large part of the selection of the particular raw materials employed to make the abrasive belt, such a selection being within the capability of one skilled in the art who is aware of the present disclosure.

The method of the invention, in one embodiment, also provides a spliceless endless fiber reinforced backing that then can be continuously coated with an abrasive coating along a surface thereof; thereby preventing the formation of discontinuities in the coated abrasive surface.

The fiber reinforcing layer of the invention can be substantially completely surrounded by (i.e., engulfed within) the organic polymeric binder material. A reinforcing layer is characterized by the presence of reinforcing fibers adjacent to the front surface of the substrate surface to which it is attached and the absence of reinforcing fibers adjacent to its exposed surface. This provides a smooth, uniform exposed surface to the backing without any protruding fibrous reinforcing material. Furthermore, the surface topology is preferably prepared so that it is free of any waviness reflecting surface irregularities of fibrous reinforcing material. Alternatively, the reinforcing material can be wound with a wetting but not necessarily engulfing amount of resin in an amount sufficient to immobilize the fiber in place on the backing substrate after drying or curing.

In a more specific embodiment of the method of the invention, the applying of the reinforcing fiber onto the spliceless backing loop substrate provides a spacing of about 2–50 strands per cm of lateral width of the endless backing loop substrate.

An abrasive layer is applied to the surface of the fiber reinforced backing loop described above to prepare an abrasive belt. The abrasive layer is typically applied to the back surface of the backing loop, i.e., the surface opposite the fiber reinforcement, but the abrasive layer may also be applied to the reinforced surface. Conventional techniques are used to apply or create the abrasive layer.

In a preferred embodiment of making the coated abrasive belt of the invention, abrasive particles are embedded in the second binder precursor layer coated over the backing surface on which the abrasive layer will be applied. Such a coating is typically called a make coat. The abrasive particles are applied to the coating of second binder precursor by a coating technique selected from the group consisting of electrostatic coating, drop coating, and magnetic coating.

The above method of making the abrasive coating further typically includes the step of applying a third binder precursor layer, as a so-called size coat, onto the embedded abrasive particles and then solidifying the binder precursor layers.

In one particular embodiment of the above-mentioned method, the manner of applying the fibrous reinforcing material comprises winding one individual fibrous reinforcing strand or narrow fibrous strip as a continuous element onto the spliceless backing loop substrate around the periphery of the front surface of the backing substrate in the form of a helix extending longitudinally to form the fiber reinforcing layer in a manner which covers substantially the entire lateral width of said front surface, and preferably covers the entire width thereof. The fibrous strand or narrow strip windings can be applied as a spiral winding side-by-side along the length of the surface of the backing substrate with their lateral edges in close proximity to provide a substantially continuous layer. This spiral winding of the reinforcing strand or strip on the preformed spliceless backing imparts increased strength and decreased stretchability to the backing.

The strand material can comprise any of a number of different types of nonmetallic or metallic fibrous material, such as glass, steel, carbon, ceramic, wool, silk, cotton, cellulose, polyvinyl alcohol, polyamide, polyester, rayon, acrylic, polypropylene, aramid, and ultrahigh molecular weight polyethylenes.

In a preferred embodiment of the method of the invention, the manner of applying the fibrous reinforcing material comprises separately winding each of at least a first individual reinforcing fibrous strand and a second individual reinforcing fibrous strand onto a spliceless backing loop substrate onto the front surface of the endless spliceless backing loop substrate in the form of a helix extending longitudinally to form the fiber reinforcing layer that spans substantially the entire lateral width of the front surface surface of the endless backing substrate. Alternately, the first and second individual reinforcing fibrous strands can be wound simultaneously. The selection of different types of wound fiber strands can be used to provide an improved balance of physical properties. For instance, in a combination of glass and polyamide fiber strands, the glass strands impart low stretch property while the polyamide strands offer strength to the fiber reinforcing layer. As another example, a combination of aramid and polyester strands provides a balance of strength/low stretch and resilience, respectively, in the fiber reinforcing layer. The reinforcing fiber material also can be a narrow fibrous strip, such as a strip of woven or knitted fabric, nonwoven mat, or a tow, having a lateral width less than the lateral width of the backing substrate to enable helical winding thereon. Further, the reinforcing fiber can be applied in separate subsets across the lateral width of the spliceless backing loop substrate. For example, continuous reinforcing fiber can be wound in multiple windings at lateral sides of the spliceless backing loop substrate and/or over a central area spaced from the side edges thereof.

In a further embodiment of the invention, the endless spliceless backing loop substrate is particularly selected from the group consisting of a polymeric film (including primed polymeric film), a woven cloth, a knitted cloth, paper, a vulcanized fiber substrate, a nonwoven, including combinations and treated versions thereof. For instance, in a preferred embodiment, the endless spliceless backing loop substrate can be selected to be a cloth structure, such as a woven or knitted cloth.

In another further embodiment of the invention, the temporary support structure is a cylindrical surface. For example, a drum which is rotatable about its central axis by a motor drive and a drum which has an expandable and/or collapsible periphery to permit adjustment of its circumference to accommodate and correspond to the particular length of the spliceless backing loop substrate is preferred.

Similar methods can also be used in preparing a coated abrasive backing using a support structure, such as a conveyor system. Such a system would typically use, for example, a stainless steel sleeve, in the form of a conveyor belt. In this embodiment, the step of preparing a fiber reinforced spliceless backing includes preparing the backing around the conveyor belt.

Other constructions, embodiments, and features of the invention will become apparent from the following description of the drawings and preferred embodiments.

DETAILED DESCRIPTION OF THE INVENTION

Detailed descriptions of the present invention are provided herein. Therefore, the invention is not limited to the specific formulations, arrangements, and methods identified and described, except as limited by the claims.

Figure 1:
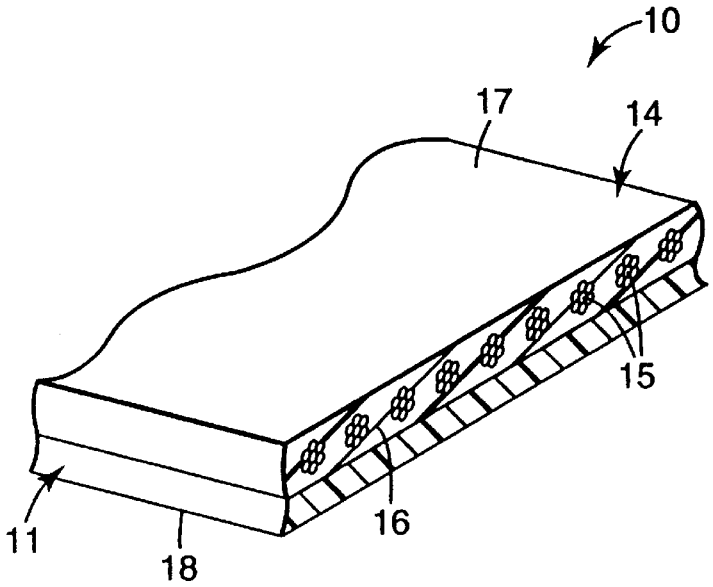
FIG. 1 is a perspective view of an enlarged fragment of a coated abrasive backing made by the method of the invention with edge surfaces revealing cross-sectional detail.

Referring to FIG. 1, a reinforced spliceless backing 10 is made by the method of the invention. In FIG. 1, backing 10 comprises an endless spliceless backing loop substrate 11 to which is adherently bonded a fiber reinforcing layer 14 which comprises reinforcing fibers 15 which are saturated with binder 16. Binder 16 adheres fibers 15 within fiber reinforcing layer 14 and to backing substrate 11. Abrasive particles are then adhered by methods, such as described herein, to at least one of the exposed surfaces, front surface 17 or back surface 18, of backing 10, either on the side of fibers 15 or spliceless backing loop substrate 11.

Binder 16 is applied to fibers 15 in a liquid or flowable state and solidified after fibers 15 are applied to backing substrate 11 by techniques described in greater detail hereinafter. Alternately, binder 16 may be applied to backing substrate 11 and then fibers 15 are applied over binder 16. Herein, the term "liquid" refers to a material that is flowable or flowing, whereas the term "solid" or "solidified" refers to a material that does not readily flow under ambient temperatures and pressures.

Figure 2:
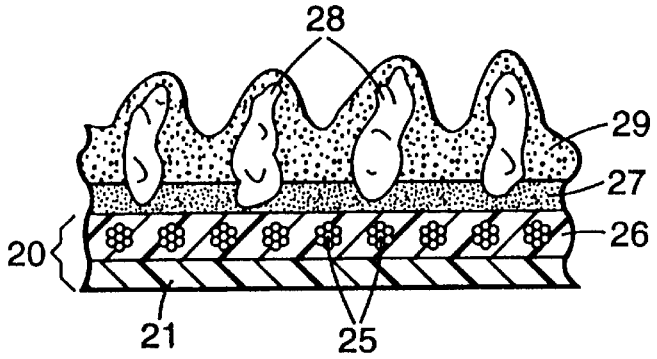
FIG. 2 is an enlarged fragmentary cross-sectional view of a coated abrasive article made by the method of the invention.

Referring to FIG. 2, the coated abrasive article, a segment of which is shown, comprises a backing 20 having an endless spliceless backing loop substrate 21. In this embodiment, reinforcing fibers 25 which are saturated with binder 26 are placed adjacent the backing substrate 21. Over the reinforcing fibers 25, a make coat 27 is first applied, then abrasive particles 28 are embedded therein. A size coat 29 is then applied over abrasive particles 28. FIG. 2 depicts the abrasive coating on the side of the backing having the reinforcing fibers; although it is to be understood that the abrasive coating alternatively, and preferably, can be provided on the side of backing substrate 21 opposite to the reinforcing fibers.

The length, width, and thickness of the reinforced backing can vary in dimension depending on the intended end use. For example, the length of the coated abrasive belt (measured on the periphery of the belt) can be any desired length although typically the length is about 40–1000 centimeters (cm).

The thickness of the endless spliceless reinforced backing 10 including spliceless backing loop substrate 11 and reinforcing fiber layer 14, is typically between about 0.07 millimeter (mm) and about 1 cm for optimum flexibility, strength, and material conservation. Further, the thickness of reinforced backing 10 preferably is consistent and uniform, i.e., it should not vary by more than about ±15% around the entire length of the backing 10, preferably not more than about±5%. Although this variance refers to a variance along the thickness of the backing 10, it generally is reflected in coated abrasive material, i.e., the coated abrasive belt. A preferred method of insuring minimal variance of the backing material, is to skive or lightly grind the exposed surface of binder layer 16 to provide a smooth, flat surface by removing any high spots which may eventually tend to reflect as imperfections in the final coated abrasive product. Preferably, care should be taken not to grind so deeply as to weaken or damage reinforcing fibers or remove too much binder material or else the strength of the backing may be affected.

Other aspects of the invention will become more apparent from the following more detailed description of the method of the invention.

Figure 3:
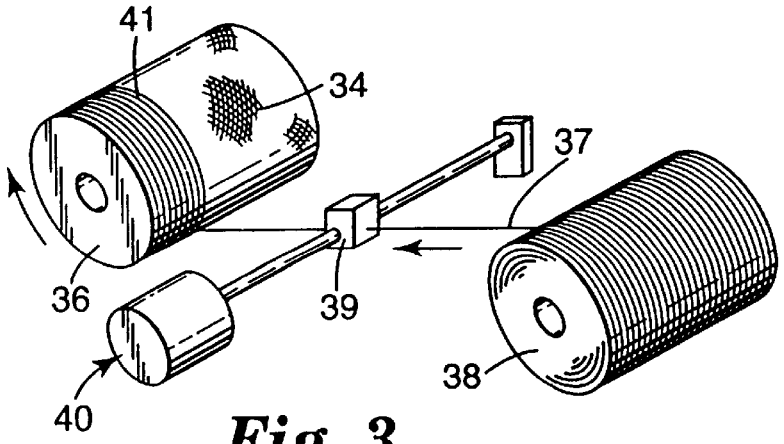
FIG. 3 is a perspective view of the major elements (without showing supporting structures) of an apparatus to practice a preferred process for making an endless spliceless reinforced backing structure according to the present invention.

In this regard, FIG. 3 illustrates key components of an apparatus used in the process for making a coated abrasive backing according to the method of the invention. The fiber reinforced backing of the invention is made on an apparatus 30. An endless spliceless backing loop substrate 31 is applied to a temporary support drum 36 which has a cylindrical surface which corresponds to the circumference of the desired reinforced backing. Typically, the circumference of the temporary support structure 36 is between about 25–350 cm, and the width is between about 15–100 cm.

Reinforcing material, in this case in the form of fibers 37, leave an unwind station 38 and are wetted with liquid binder precursor material at level winder station 39. These saturated fibers are then applied onto the spliceless backing 31. The winding procedure involves the use of a strand guide system 40 with level winder 39. In this method, drum 36 is rotated (typically 25–75 rpm) while the reinforcing fibers 37 are initially attached to the spliceless backing loop substrate 31 fitted to drum 36, and are pulled through the level winder 39, and are wound around the drum 36 helically or spirally across the width of the drum, such that the applied layer of the strand 41, upon completion of winding, is no wider than backing substrate 31.

It is preferred that the level winder 39 move across the width of the drum such that the continuous reinforcing fibers 37 are uniformly applied in a layer across the width of the spliceless substrate 31. Thus, fiber 37 is in a helically wound pattern of a plurality of wraps in a layer within the organic polymeric binder material, with each wrap of the strand parallel to the previous wrap of the strand. Furthermore, the individual wraps of the fiber 37 are at a constant nonzero angle relative to the parallel side edges of the backing substrate 31. The reinforcing fibers are wound onto endless spliceless backing substrate 31 with a spacing of about 2–50 strands per cm of width; although it is to be understood that a broader range of strand spacing is contemplated within the scope of the invention. The spacing selected can depend on a number of variables, such as the strand material(s), reinforcing strength needed as a function of the type of backing material selected and type of service intended for the coated abrasive articles, among others.

It is possible that several strands may be used to cover the entire width of the web backing in case that the strands have sufficient length to revolve more than once around the circumference of the backing web but are not sufficiently long to traverse the entire lateral width of the backing web.

Sufficient uncured resin 34 is applied to the backing substrate 31 to provide a layer of resin at least above and below the reinforcing fiber material therein, i.e., on the outer surfaces and sometimes even the interior of the reinforcing material. The binder precursor material not only can be applied to the fibers before winding, but, alternatively, it can be applied directly on backing substrate 31 after disposition on drum 36 and before winding over the substrate 31 over the previously wound strands, or in any combinations of these coating procedures to provide adhesion of the reinforcing fibers 37 to the backing substrate 31.

It is preferred that the binder precursor used to coat the strands is exposed to an energy source (not shown), either thermal energy or radiation energy, to cure of polymerize the binder precursor. Further processing may then occur such as additional curing, flexing and/or humidification. After this optional further processing, the endless spliceless backing can be converted or slit into the desired form or shape in preparation for use as an abrasive article backing.

The temporary support structure 36 used in such a method is preferably a drum, which can be made from a rigid material such as steel, metal, ceramic, a strong plastic material, or any combination thereof. The material of which the drum is made should have enough integrity such that repeated endless backings can be made without any damage to the drum. The drum is placed on a mandrel so that it can be rotated at a controlled rate by a motor. This rotation can range anywhere from 1 to 100 revolutions per minute (rpm) depending on the application. The drum is usually a rotatable one in the practice of the invention. Although, it is also contemplated that the drum could be nonrotatable where the strand applying means is capable of traveling around the circumference of the drum.

The drum can be unitary or created of segments or pieces that collapse for easy removal of the endless, spliceless backing.

The circumference of the drum will generally correspond to the inner length (circumference) of the endless, spliceless backing loop substrate. The width of the endless, spliceless backing loop substrate can be of any value less than the width of the drum. A single endless, spliceless backing can be made on the drum, removed from the drum, and the sides can be trimmed. Additionally, the reinforced backing can be slit longitudinally into multiple reinforced backings with each having a width substantially less than the original backing.

In many instances, it is preferred that a release coating be applied to the periphery of the drum before the binder precursor or spliceless backing loop substrate or any of the other components are applied. This provides for easy release of the endless, spliceless backing after the binder is solidified. In most instances, this release coating will not become part of the endless, spliceless backing. If a collapsible drum is used in the preparation of a large endless, spliceless backing, such a release liner helps to prevent, or at least reduce, the formation of ridges in the inner surface of the reinforced backing, caused by seams or welds in the drum surface. Examples of such release coatings include, but are not limited to, waxes, silicone waxes or fluorochemicals, or polymeric films coated with silicone waxes or fluorochemicals. It is also within the scope of this invention to use a second release coating which is placed over the final or top coating of the binder. This second release coating is typically present during the solidification of the binder, and can be removed afterwards.

Alternatively, in the preparation of a coated abrasive article of the present invention, the reinforcing fiber layer can be applied to the spliceless backing loop substrate supported around two drum rollers, which are connected to a motor for driving at least one of rollers to rotate the backing. Alternatively, the backing can be installed around one drum roller, which is connected to a motor for rotating the backing. As the backing rotates, the adhesive layers or abrasive slurry are applied by any conventional coating technique such as knife coating, die coating, roll coating, spray coating, or curtain coating. Spray coating is preferred for certain applications.

After applying the fibrous reinforcing material to the spliceless backing loop substrate and curing the binder precursor, in this embodiment, the resulting backing is removed from the temporary drum, optionally ground to remove any high spots, and then the abrasive coating is applied to either of the fiber reinforcing layer or the opposite side of the spliceless backing substrate. The fiber reinforced backing should be turned inside out (everted) to expose the opposite surface of the spliceless backing substrate, i.e., the side of the backing substrate opposite to the fiber reinforcing layer, if the abrasive coating is to be applied to that surface. Either way, the fiber reinforced backing is again temporarily supported on any convenient support means such as either a drum or at least two cantilevered idler rolls for application of an abrasive slurry or abrasive coating (sequential coating of make coat and abrasive particles).

If an abrasive slurry is not used, i.e., if the abrasive material is applied after a second or make adhesive layer is applied, the abrasive grains can be electrostatically deposited onto the adhesive layer by an electrostatic coater. The drum roller acts as the ground plate for the electrostatic coater. Alternatively, the abrasive grains can be applied by mineral drop coating or magnetic coating.

Preferably, the make coat layer is solidified, or at least partially solidified, after embedding the abrasive particles, and then a size coat layer (and optionally a supersize coat) is applied. The size coat adhesive layer can be applied by any conventional method, such as roll coating, spray coating, or curtain coating. The size coat is preferably applied by spray coating. The make and size coats layer(s) can then be fully solidified while the backing is still on the drum rollers. Alternatively, the resulting product can be removed from the drum rollers prior to solidification of the adhesive layer(s).

Examples of the specific materials employed in the method and coated abrasive product of the invention are described in greater detail hereinafter.

The coated abrasive articles of the present invention include a fiber reinforced backing with the following properties. The reinforced backing is sufficiently heat resistant under grinding conditions for which the abrasive article is intended to be used such that the backing does not significantly disintegrate, i.e., split, break, delaminate, tear, or a combination of these, as a result of the heat generated during a grinding, sanding, or polishing operation. The reinforced backing is also sufficiently tough such that it will not significantly crack or shatter from the forces encountered under grinding conditions for which the abrasive article is intended to be used. That is, it is sufficiently stiff to withstand typical grinding conditions encountered by coated abrasive belts, but not undesirably brittle.

Preferably, the reinforced backings, and spliceless endless coated abrasive belts incorporating same, of the present invention are sufficiently flexible to withstand grinding conditions. By "sufficient flexibility" and variants thereof in this context, it is meant that the reinforced backings, and spliceless endless coated abrasive belts, will flex or bend under typical grinding conditions and return to their original shape without significant permanent deformation. Furthermore, for preferred grinding applications, the reinforced backing (and the endless abrasive belt incorporating same) is capable of flexing and adapting to the contour of workpiece being abraded, yet is sufficiently strong to transmit an effective grinding force when pressed against the workpiece.

Preferred reinforced backings of the present invention possess a generally uniform tensile strength in the longitudinal, i.e., machine direction. This is typically because the fibrous reinforcing material extends along the entire length of the backing and there is no seam in the continuous fibrous reinforcing material. More preferably, the tensile strength for any portion of a reinforced backing tested does not vary by more than about 20% from that of any other portion of the reinforced backing structure. Tensile strength is generally a measure of the maximum stress a material subjected to a stretching load can withstand without tearing.

Preferred reinforced backings of the present invention also exhibit appropriate shape control and are sufficiently insensitive to environmental conditions, such as humidity and temperature. By this it is meant that preferred reinforced backings of the present invention possess the above-listed properties under a wide range of environmental conditions. Preferably, the reinforced backings possess the above-listed properties within a temperature range of about 10°–30° C., and a humidity range of about 30–90% relative humidity (RH). More preferably, the reinforced backings possess the above-listed properties under a wide range of temperatures, i.e., from below 0C to above 100° C., and a wide range of humidity values, from below 10% RH to 100% RH.

The reinforced backings should also be able to withstand the grinding conditions and environments to which the coated abrasive article product is intended.

Backing Substrate

The preferred backing substrate material used in coated abrasive backings of the present invention is generally chosen such that there will be compatibility with, and good adhesion to, the adhesive layers, particularly to the make coat. Good adhesion is determined by the amount of "shelling" of the abrasive material. Shelling is a term used in the abrasive industry to describe the undesired, premature release of a significant amount of the abrasive material from the backing. Although the choice of backing substrate material is important, the amount of shelling typically depends to a greater extent on the choice of adhesive and the compatibility of the backing substrate and adhesive layers and grinding conditions.

The backing substrate is comprised of an endless, spliceless (tube-like) backing substrate. The backing substrate is then reinforced by continuously wound fibrous material, such as yarn, to provide the backing described herein.

The endless spliceless backing loop substrate is generally selected from the group consisting of a polymeric film (including primed polymeric film), a woven cloth, a knitted cloth, paper, a vulcanized fiber substrate, a nonwoven, including combinations and treated versions thereof.

The preferred endless backing substrate is a cloth backing, either woven or knitted. Examples of materials useful as endless spliceless backing loop substrates in this invention include polyester, nylon, rayon, cotton, jute, and other materials know as cloth backings. The cloth is composed of yarns in the warp direction, i.e., the machine direction, and yarns in the fill direction, i.e. the cross direction. The cloth backing substrate can be a woven backing, a stitchbonded backing, or a weft insertion backing. Examples of woven constructions include sateen weaves of 4 over one weave of the warp yarns over the fill yearns; twill weave of 2 or 3 over one weave; plain weave of one over one weave; and a drill weave of two over two weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive. The endless spliceless backing is generally a tubular backing, meaning there can be found no appreciable beginning or end.

Endless spliceless backing loop substrates are available from suppliers such as, for example, Advanced Belt Technology (of Middletown, CT) under the designations "WT3" and "WT4", and other various cloth manufacturers.

The yarns in the cloth backing substrate can be natural, synthetic or combinations thereof. Examples of natural yarns include cellulosic yarns such as cotton, hemp, kapok, flax, sisal, jute, carbon, manila, and combinations thereof. Examples of synthetic yarns include polyester yarns, polypropylene yarns, glass yarns, polyvinyl alcohol yarns, polyimide yarns, aromatic polyamide yarns, rayon yarns, nylon yarns, polyethylene yarns and combinations thereof. The preferred yarns of this invention are polyester yarns, nylon yarns, a mixture of polyester and cotton, rayon yarns, and aromatic polyamide yarns.

The cloth backing substrate can be dyed and/or stretched, desized, washed, or heat stretched. Additionally the yarns in the cloth backing can contain primers, dyes, pigments or wetting agents. The yarns can be twisted or textured.

Polyester yarns are formed from a long chain polymer made from the reaction of an ester of dihydric alcohol and terephthalic acid; preferably this polymer is a linear polymer of poly(ethylene terephthalate). There are three main types of polyester yarns: ring spun, open end and filament. A ring spun yarn is made by continuously drafting a polyester yarn, twisting the yarn and winding the yarn on a bobbin. An open end yarn is made directly from a sliver or roving. A series of polyester rovings are opened and then all of the rovings are continuously brought together in a spinning apparatus to form a continuous yarn. A filament yarn is a long continuous fiber; a filament yarn typically has a very low or nonexistent twist to the polyester fiber.

The denier of the fibers should be less than about 5000, preferably between about 100 to 1500. The yarn size should range from about 1500 to 12,000 meters/kilogram. For a coated abrasive cloth backing, the weight of the greige cloth, i.e., the untreated cloth, will range from about 0.15 to 1 $kg/M^2$, preferably between about 0.15 to 0.75 $kg/m^2$.

The backing substrate may have an optional saturant resin coat, presize coat and/or backsize coat. If the backing substrate is a cloth backing substrate, at least one of these coats is required. The purpose of these coats is to seal the backing substrate and/or protect the yarns or fibers in the backing substrate. The addition of the presize coat or backsize coat may additionally result in a "smoother" surface on either the front or back side of the backing substrate. The presize or backsize coat may penetrate through the entire thickness of the backing substrate, or may be applied so that the coating only penetrates half of the substrate thickness. The depth of penetration can be controlled by the viscosity of the various coatings. Viscosity can be altered, for example, by silica or clay additions.

After any one of the saturant coat, backsize coat or presize coat is applied to the backing substrate, the resulting backing substrate can be heat treated or calendered. The heat treating can be done as the binder precursor is at least partially solidified by placing the backing substrate in a tenter frame which is in an oven. Additionally the backing substrate can be processed through heated hot cans. The calendering step will remove some surface roughness and typically increase the surface smoothness.

Examples of latex resins that can be mixed with the phenolic resin to treat the cloth backing include acrylonitrile butadiene emulsions, acrylic emulsions, butadiene emulsions, butadiene styrene emulsions and combinations thereof. These latex resins are commercially available under various tradenames from a variety of different sources including: "RHOPLEX" and "ACRYLSOL" commercially available from Rohm and Haas Company, "FLEXCRYL" and "VALTAC" commercially available from Air Products & Chemicals Inc., "SYNTHEMUL" and "TYLAC" commercially available from Reichold Chemical Co., "HYCAR" and "GOODRITE" commercially available from B.F. Goodrich, "CHEMIGUM" commercially available from Goodyear Tire and Rubber co., "NEOCRYL" commercially available from ICI, "BUTAFON" commercially available from BASF, and "RES" commercially available from Union Carbide.

The backing substrate may additionally comprise other optional materials, such as additives selected from the group consisting of fillers, fibers, antistatic agents, lubricants, wetting agents, surfactants, pigments, dyes, coupling agents, plasticizers, and suspending agents, such as those described for backings in PCT Published Application No. WO 93/12911 published 8 Jul. 1993 (Benedict et al.). The amounts of these materials are selected to provide the properties desired.

Fibrous Reinforcing Material

The fibrous reinforcing material used in the invention to reinforce the spliceless backing loop substrate preferably is in the form of individual fibrous strands. Alternatively, the material can be a narrow fibrous strip having a lateral width less than that of the backing substrate, such as in a preferred ratio of 1/100 to 10/100.

Suitable fibrous strands for this invention are commercially available as threads, cords, yarns, rovings, and filaments. Threads and cords are typically assemblages of yarns. A thread has a very high degree of twist with a low friction surface. A cord can be assembled by braiding or twisting yarns and is generally larger than a thread. A yarn is a plurality of fibers or filaments either twisted together or entangled. A roving is a plurality of fibers or filaments pulled together either without a twist or with minimal twist. A filament is a continuous fiber. Both roving and yarns are composed on individual filaments. A fiber mat or web consists of a matrix of fibers, i.e., fine thread like pieces with an aspect ration of at least about 100:1. The aspect ratio of a fiber is the ratio of the longer dimension of the fiber to the shorter dimension.

In general, the fibrous reinforcing material can be composed of any material that increases the strength of the backing and/or prevents stretch. Examples of useful reinforcing fibrous material in applications of the present invention include metallic or nonmetallic fibrous material, with the preferred being nonmetallic. The nonmetallic fibrous materials may be materials made of glass including "FIBERGLAS", carbon minerals, synthetic or natural heat resistant organic reinforcing materials, or ceramic materials. Preferred fibrous reinforcing materials for the present invention are organic materials, glass, and ceramic fibrous material. Useful natural organic fibrous materials include wool, silk, cotton, or cellulose. Examples of useful synthetic organic fibrous materials are made from polyvinyl alcohol, nylon, polypropylene, polyester, rayon, polyamide, acrylic, polyolefin, aramid, or phenol. The preferred organic fibrous material for applications of the present invention is aramid fibrous material; such a material is commercially available from DuPont Co. under the trade names of "KEVLAR" and "NOMEX". It is also possible to have more than one type of reinforcing fiber in the backing construction. Generally, any ceramic fibrous reinforcing material is useful in applications of the present invention. An example of a ceramic fibrous reinforcing material suitable for the present invention is "NEXTEL" is commercially available from The 3M Company.

It is possible to use more than one type of reinforcing fiber in this construction. Different fibers, such as "FIBERGLAS" and nylon, or "FIBERGLAS" and polyester, or aramid and nylon, or aramid and polyester, can be used in combination as the types of strand material by alternate winding of each type across the width of the preformed spliceless backing, either in the same winding direction or in a criss-cross type winding. The different fibers used should be chosen for their desirable properties, such as low stretch for fiberglass and high strength for nylon. It is also possible to co-twist 2 or more strands together, the strands being the same or different in any of composition, denier, twist and so forth, and then apply the resulting yarn to the spliceless backing as a single strand. The different strands can be selected to contribute different desired physical properties to the composite co-twisted fiber to provide a balance of properties.

The reinforcing fibers may contain a pretreatment of some kind, prior to being incorporated into the backing. This pretreatment may be an adhesion promoter or a slashing compound. For example, the fiberglass reinforcing fibers may contain a surface treatment, such as an epoxy or urethane compatible fiberglass yarn to promote adhesion to the make coat. Examples of such fiberglass yarns are "930" fiberglass yarns from PPG, Pittsburgh, Pa, and "603" fiberglass yarns from Owens-Corning. Useful grades of such glass yarns and rovings are in the range of about 150 to 32,000 meters/kg, which are also preferred.

If glass fibrous reinforcing material is used, it is preferred that the glass fibrous material be accompanied by an interfacial binding agent, i.e., a coupling agent, such as a silane coupling agent, to improve adhesion to the organic binder material, particularly if a thermoplastic binder material is used. Examples of silane coupling agents include "Z-6020" or "Z-6040" both available from Dow Corning Corp.

It is required that the fibrous reinforcing material is of a length sufficient to extend around the length, i.e., circumference, of the coated abrasive loop a plurality of times and provide at least one distinct layer of fibrous reinforcing material. In other words, the fibrous reinforcing material is of a length sufficient to place the strand in a helically wound pattern of a plurality of wraps in a layer within the organic polymeric binder material, with each wrap of the strand parallel to and in contact with the previous wrap of the strand. This helix generally and preferably extends longitudinally along the entire length of the backing loop. That is, each wrap of the strand approaches a parallel position relative to the side edges of the loop, although no individual wrap exactly parallels the side edges. Rather, the wraps are preferably at a constant, substantially nonzero angle relative to the parallel side edges of the spliceless backing substrate or web.

The reinforcing fiber denier, i.e., degree of fineness, for preferred fibrous reinforcing material ranges from about 5 to about 5000 denier, typically between about 50 and about 2000 denier. More preferably, the fiber denier will be between about 100 and about 1500. It is understood that the denier is strongly influenced by the particular type of fibrous reinforcing material employed.

It is possible in this invention that there are provided distinct regions of the backing (spliceless backing loop substrate/reinforcing layer) that do not have fibrous reinforcing material therein. This results in one area of the backing having a greater ratio of fibrous reinforcing material to organic polymeric binder material than another area. For example, the fibrous reinforcing material can be entirely located within a region in the lateral sides and/or the central area of the backing layer such that some outer edges thereof would be substantially uncovered by fibrous reinforcing material. This embodiment may not be acceptable in all cases as it may create an uneven surface on the backing.

In reinforcing the backing substrate, the fibrous reinforcing material is applied onto the spliceless backing loop substrate which is temporarily held on a support structure described herein, such as a drum structure. The binder precursor can be applied first to the spliceless backing loop substrate, followed by winding of the reinforcing material. Alternatively, the reinforcing material can be applied first to the spliceless backing loop substrate, followed by the binder precursor. In a third embodiment, the reinforcing material can be first saturated with the binder precursor and then applied to the spliceless backing loop substrate. Thus, the binder precursor can be applied sequentially or simultaneously with the reinforcing material. It is also within the scope of this invention to use a combination of any of these three previous methods.

It is also within the scope of the invention to use a nonwoven substrate in combination with the reinforcing fibers. The nonwoven substrate, in some instances, can increase the tear strength of the resulting backing. It is contemplated for instance, that a nonwoven substrate is first saturated with a first binder precursor and applied over the second surface of the backing substrate. Next, the reinforcing yarns are applied on top of the saturated nonwoven substrate. The first binder precursor will wet the reinforcing yarns and bond the reinforcing yarns to the backing substrate.

In one aspect of the invention, the reinforcing fibers are applied to an endless spliceless backing loop substrate already containing an abrasive coating. In this aspect, the backing substrate is turned inside out, i.e., the abrasive coating faces the support drum and the reinforcing fibers are applied to the backing substrate surface opposite the abrasive coating. After the reinforcing fibers are applied and the binder precursor is solidified, the resulting endless belt is essentially turned inside out to form the endless coated abrasive article.

The resulting endless abrasive belt article of the invention comprises a backing having a spliceless backing loop substrate and a plurality of reinforcing fibers continuously present over the surface area. It is generally preferred that the reinforcing fibers be parallel and non-interlacing as applied upon the backing substrate. It is also within the scope of this invention that the reinforcing fibers are continuous over the entire lateral width of the spliceless backing loop substrate, i.e., there is no substantial break or gap in the spacing of the reinforcing fibers across the width of the backing substrate. It is understood that the reinforcing fiber will have a starting end and a tail end with the intervening length of the fiber continuous in at least more than one revolution around the spliceless backing loop substrate.

While the use of preformed fibers are preferred as the fibrous reinforcing material, the use of monofilament thermoplastic and thermoelastic beads extruded and cooled in-situ as helical windings over the spliceless backing substrate are also contemplated.

Binder Precursor Material for Reinforcing Fibers

The binder precursor material used for securing the fibrous reinforcing material strands or narrow strips can be selected from a wide variety of binder materials which can be applied in liquid form and later solidified. Typically, the amount of binder precursor, which is an organic polymeric binder material, used to saturate the reinforcing fibers is within a range of about 40–99 wt%, more preferably within a range of about 65–92 wt%, and most preferably within a range of about 70–85 wt%, based on the total weight of the fiber reinforcing layer alone.

The binder material used to secure the reinforcing material in the fiber reinforcing layer is an organic polymeric binder material. It can be a cured or solidified thermosetting resin, thermoplastic material, or elastomeric material. Preferably, the organic polymeric binder material is a cured or solidified thermosetting resin. It is preferred that the binder material is a thermosetting resin, at least because such resins can be provided in a very fluid (low viscosity) flowable form when uncured, even under ambient conditions. Herein, the phrase "ambient conditions" and variants thereof refer to room temperature, i.e., 15°–30° C., generally about 20°–25° C., and 30–50% relative humidity, generally about 35–45% relative humidity.

If the organic polymeric binder material of the backing includes a curable thermosetting resin, prior to the manufacture of the backing, such as for wetting the reinforcing fibers 15 and/or for impregnating a cloth backing web 11 with a binder precursor, the thermosetting resin is in a nonpolymerized state, typically in a liquid or semiliquid state. During the manufacturing process, the thermosetting resin is cured or polymerized to a solid state. Depending upon the particular thermosetting resin employed, the thermosetting resin can use a curing agent or catalyst. When this curing agent is exposed to an appropriate energy source (such as thermal energy or radiation energy) the curing agent will initiate the polymerization of the thermosetting resin.

Examples of thermosetting resins from which the backing can be prepared include phenolic resins, amino resins, polyester resins, aminoplast resins, urethane resins, melamine-formaldehyde resins, epoxy resins, acrylated isocyanurate resins, urea-formaldehyde resins, acrylate resins and mixtures of isocyanurate resins, acrylated urethane resins, acrylated epoxy resins, or mixtures thereof. The preferred thermosetting resins are urethane resins, acrylate resins, epoxy resins, acrylated urethane resins, polyester resins, or flexible phenolic resins, and mixtures thereof. The most preferred resins are urethane resins, acrylate resins, epoxy resins, acrylated urethane resins, and mixtures thereof, because they exhibit an acceptable cure rate, flexibility, good thermal stability, strength, and water resistance.

One preferred class of binder material is polyurethane elastomer, in particular a polyether based polyurethane. Examples of such polyurethane materials are commercially available from Uniroyal Chemical under the trade designation "VIBRATHANE" and "ADIPRENE". These polyurethane elastomers are formed from prepolymers that can be a polyether based upon toluene diioscyanate terminated prepolymer or a polyether based upon diphenylmethane diisocyanate. These prepolymers can be crosslinked with 4,4'-methylene-bis-(ortho-chloroaniline) or a diamine curative. The polyurethane binders are also preferred, because during thermal curing the polyurethane resins do not appreciably reduce their viscosity and thus do not appreciably flow during curing. It is also within the scope of this invention to blend polyurethane resins with epoxy resins and acrylate resins.

Phenolic resins are usually categorized as resole or novolac phenolic resins. Examples of useful commercially available phenolic resins are "VARCUM" from BTL Specialty Resins Corporation; "AROFENE" from Ashland Chemical Company; "BAKELITE" from Union Carbide; and "RESINOX" from Monsanto Chemical Company.

Resole phenolic resins are characterized by being alkaline catalyzed and having a molar ratio of formaldehyde to phenol of greater than or equal to 1:1. Typically, the ratio of formaldehyde to phenol is within a range of about 1:1 to about 3:1. Examples of alkaline catalysts useable to prepare resole phenolic resins include sodium hydroxide, potassium hydroxide, organic amines, or sodium carbonate.

Novolac phenolic resins are characterized by being acid catalyzed and having a molar ratio of formaldehyde to phenol of less than 1:1. Typically, the ratio of formaldehyde to phenol is within a range of about 0.5:1 to about 0.8:1. Examples of the acid catalysts used to prepare novolac phenolic resins include sulfuric, hydrochloric, phosphoric, oxalic, or p-toluenesulfonic acids. Although novolac phenolic resins are typically considered to be thermoplastic resins rather than thermosetting resins, they can react with other chemicals (e.g., hexamethylenetetraamine) to form a cured thermosetting resin.

Epoxy resins useful in the polymerizable mixture used to prepare backings of this invention include monomeric or polymeric epoxides. Useful epoxy materials, i.e., epoxides, can vary greatly in the nature of their backbones and substituent groups. Representative examples of acceptable substituent groups include halogens, ester groups, ether groups, sulfonate groups, siloxane groups, nitro groups, or phosphate groups. The weight average molecular weight of the epoxy-containing polymeric materials can vary from about 60 to about 4000, and are preferably within a range of about 100 to about 600. Mixtures of various epoxy-containing materials can be used in the compositions of this invention. Examples of commercially available epoxy resins include "EPON" from Shell Chemical Co.; and "DER" from Dow Chemical Company.

Examples of commercially available urea-formaldehyde resins include "UFORMITE" from Reichold Chemical, Inc.; "DURITE" from Borden Chemical Co.; and "RESIMENE" from Monsanto. Examples of commercially available melamineformaldehyde resins include "UFORMITE" from Reichhold Chemical, Inc. NC; and "RESIMENE" from Monsanto. "RESIMENE" is used to refer to both urea-formaldehyde and melamine-formaldehyde resins.

Examples of aminoplast resins useful in applications according to the present invention are those having at least one pendant alpha, beta-unsaturated carbonyl groups per molecule, which are disclosed, for example, in U.S. Pat. Nos. 4,903,440 (Larson et al.) and 5,236,472 (Kirk et al.).

Useable acrylated isocyanurate resins are those prepared from a mixture of: at least one monomer selected from the group consisting of isocyanurate derivatives having at least one terminal or pendant acrylate group and isocyanate derivatives having at least one terminal or pendant acrylate group; and at least one aliphatic or cycloaliphatic monomer having at least one terminal or pendant acrylate group. These acrylated isocyanurate resins are described, for example, in U.S. Pat. No. 4,652,274 (Boettcher et al.).

Ethylenically unsaturated resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, propyleneglycol diacrylate, trimethylolpropane triacrylate, glycerol triacrylate pentaerythritol triacrylate, pentaerythritol methacrylate, tetraacrylate. Other ethylenically unsaturated resins include monoallyl, polyallyl, and polymethallyl esters and diallyl adipate, and N,N-diallyladipamide. Still other nitrogen containing compounds include tris(2-acryloyloxyethyl) isocyanurate, 1,3,5-tri(2-methylacryloxyethyl)s-triazine, acrylamide, methlacrylamide, Nmethylacrylamide, N-N-dimethylacrylamide, Nvinylpyrrolidone, and N-vinylpiperidone.

Acrylate urethanes are diacrylate esters of hydroxy terminated NCO extended polyesters or polyethers. Examples of commercially available acrylated urethanes include "UVITHANE 782", available from Morton Thiokol Chemical, and "CMD 6600", "CMD 8400", and "CMD 8805", available from Radcure Specialties.

The acrylated epoxies are diacrylate esters, such as the diacrylate esters of bisphenol A epoxy resin. Examples of commercially available acrylated epoxies include those having the trade names "EBECRYL 3500", "EBECRYL 3600", and "EBECRYL 8805", available from Radcure Specialties.

Suitable thermosetting polyester resins are available as "E-737" or "E-650" from Owens-Corning Fiberglass Corp. Suitable polyurethanes also are available as "VIBRATHANE" B-813 prepolymer or "ADIPRENE" BL-16 prepolymer used with "CAYTUR"-31 curative. All are available from Uniroyal Chemical.

As indicated previously, in some applications of the present invention, a thermoplastic binder material can be used to bond the reinforcing fibers wound to the backing substrate, as opposed to the preferred thermosetting resins discussed above. A thermoplastic binder material is a polymeric material that softens when exposed to elevated temperatures and generally returns to its original physical state when cooled to ambient temperatures. During the manufacturing process, the thermoplastic binder is heated above its softening temperature, and often above its melting temperature, to be in a flowable state. After the reinforced fibers are bonded to the backing substrate, the thermoplastic binder is cooled and solidified.

Preferred thermoplastic materials of the invention are those having a high melting temperature and/or good heat resistant properties. That is, preferred thermoplastic materials have a melting point of at least about 100° C., preferably at least about 150° C. Additionally, the melting point of the preferred thermoplastic materials is sufficiently lower, i.e., at least about 25° C. lower, than the melting temperature of the reinforcing material. In this way, the reinforcing material is not adversely effected during the melting process of the thermoplastic binder.

Examples of thermoplastic materials suitable for preparations of backings in articles according to the present invention include polycarbonates, polyetherimides, polyesters, polysulfones, polystyrenes, acrylonitrilebutadiene-styrene block copolymers, polypropylenes, acetal polymers, polyamides, polyvinyl chlorides, polyethylenes, polyurethanes, or combinations thereof. Of this list, polyamides, polyurethanes, and polyvinyl chlorides are preferred, with polyurethanes and polyvinyl chlorides being most preferred.

If the thermoplastic material from which the backing is formed is a polycarbonate, polyetherimide, polyester, polysulfone, or polystyrene material, a primer can be used to enhance the adhesion between the fiber reinforcing layer and the make coat, if the make coat is chosen to be applied on that side of the backing. The term "primer" is meant to include both mechanical and chemical type primers or priming processes. This is not meant to include a layer of cloth or fabric attached to the surface of the backing. Examples of mechanical primers include, but are not limited to, corona treatment and scuffing, both of which increase the surface area of the surface. An example of a chemical primer is a colloidal dispersion of, for example, polyurethane, acetone, a colloidal oxide of silicon, isopropanol, and water, as disclosed, for example, by U.S. Pat. No. 4,906,523 (Bilkadi et al.).

Although priming of a surface can involve scuffing, i.e., roughening up to increase the surface area of the surface, the surface of the backing is still relatively "smooth" as defined above. That is, the surface topology is generally smooth and flat such that there is little, if any, exposed, i.e., protruding, fibrous reinforcing material. Preferably, the surface topology is generally not effected by the fibrous reinforcing material within the organic polymeric binder material such that it would mirror the underlying topology of the fibrous reinforcing material.

A third type of binder useful in the saturating the reinforcing fibers of the present invention is an elastomeric material. An elastomeric material, i.e., elastomer, is defined as a material that can be stretched to at least twice its original length and then retract very rapidly to approximately its original length, when released. Examples of elastomeric materials useful in applications of the present invention include styrenebutadiene copolymers, polychloroprene (neoprene), nitrile rubber, butyl rubber, polysulfide rubber, bis-1,4-polyisoprene, ethylene-propylene terpolymers, silicon rubber, or polyurethane rubber. In some instances, the elastomeric materials can be crosslinked with sulfur, peroxides, or similar curing agents to form cured thermosetting resins.

Care should be taken to monitor the viscosity of the binder material during its application to the reinforcing fiber strands. If the viscosity of the binder precursor is too low, then during further processing of the abrasive article, the binder precursor will tend to flow or "run". This flow is undesirable and may cause the placement and orientation of the reinforcing fibers to shift. On the other hand, if the viscosity of the binder precursor is too high, then the binder precursor may not adequately wet the reinforcing fibers. A preferred viscosity range is between about 500 to 20,000 centipoise, more preferably between 1,000 and 15,000 and most preferred between 2,000 to 10,000 centipoises. These viscosity measurements are taken at room temperature. The viscosity may be adjusted by the amount of solvent (the % solids of the resin) and/or the chemistry of the starting resin.

Heat may additionally be applied during the applying of the reinforcing strands to the spliceless backing substrate on the temporary support to effect better wetting of the binder precursor onto the reinforcing fibers. However, the amount of heat should be controlled such that there is not premature solidification of the binder precursor.

The binder preferably should substantially engulf or encase the reinforcing fibers. The binder precursor will wet the majority of the reinforcing fibers, however there may be a minor, preferably a very minor amount of reinforcing fibers that are not engulfed by the binder precursor. There should be sufficient binder to substantially fill in any gaps or spaces between the reinforcing fibers, although at times it may be desired that some texture remains. The term "sufficient" means that there is enough binder precursor to provide an abrasive backing that has the desired properties for the intended application. These properties include tensile strength, heat resistance, tear resistance, stretch, and the like. There may be sufficient binder within a backing, and still have some internal porosity. Again, however, it is preferred that this internal porosity be minimized. Additionally, the binder will typically seal the back side of the backing to provide an continuous layer or coating on the back side of the spliceless backing substrate. The term seal means that a liquid, such as water, cannot penetrate into the backing through the back side of the backing.

Typically, the binder precursor is solidified by exposure to an energy source, such as thermal energy or radiation energy. The fiber reinforced backing structure can be rotated on the drum during thermal curing. This rotation can minimize the binder precursor from flowing during its curing to form a nonsmooth contour, and thus ultimately minimizes the shifting of abrasive particles if later applied to the fiber reinforcing layer during a curing of a make coat.

One preferred method of making the reinforced backing structure of the invention is to first provide an endless spliceless backing loop substrate which has the length of the final desired belt length; this backing is then removably applied to a support structure or drum. Alternating yarns or strands of nylon and fiberglass then are applied over the spliceless backing substrate by winding techniques described hereinabove. Alternatively, the two different types of fibers can be polyester and aramid. As the yarns are applied, the tension should be set such that the yarns are pulled down onto the spliceless backing substrate. This tension will also help promote wetting of the binder precursor onto the reinforcing yarns. There is sufficient binder precursor used to at least wet the reinforcing yarns before, during or after their application to the surface of the backing substrate.

In some instances, to make a uniform backing, the fibrous reinforcing material is applied in two wound layers, these two layers having windings which cross in inclination. It is preferred that after the first winding is applied, the binder precursor is at least partially cured before a second winding (including additional binder precursor) is applied.

In one further optional embodiment of the invention, garnet, silica, polymer particles, or coke particles, and the like, can be dispersed, such as by electrostatic coating, slurry coating, drop coating, or spray coating, in a resin akin to that used to wet the fibrous reinforcing strands. This dispersion can be coated onto either the exposed side of the backing substrate or the fiber reinforcing layer, whichever side is opposite to the side ultimately bearing the abrasive coating, to impart texture to provide a frictional grip coat or traction coat. This traction coat can facilitate the driving of the belt. The traction coat also could be formed of a binder precursor with mineral particles or fibers dispersed therein, or woven or nonwoven webs.

Abrasive Coating

The reinforced backing structure, comprising a spliceless backing loop substrate and the fibrous reinforcing material applied thereover as described herein, is then used as a coated abrasive backing. The abrasive material can be applied by any known means, i.e., drop coating, slurry coating, electrostatic coating, roll coating, etc. The abrasive coating is preferably applied to the side of the backing having the spliceless conventional backing due to the increased adhesion to the conventional backing over the fibers.

Once the fiber reinforced backing is formed, the introduction of abrasive particles and several adhesive layers, which are typically also applied in binder precursor form, is contemplated in the context of forming the abrasive coating surface of the article.

Make Coat

A make coat, or second adhesive layer, can be applied to either side of the backing, the spliceless backing substrate side or the reinforcing fiber layer side, however the spliceless backing substrate side is preferred. The make coat binder precursor can be coated by any conventional technique, such as knife coating, spray coating, roll coating, rotogravure coating, and the like.

The composition of the adhesive layers which relate to the make coat and the size and supersize coats mentioned below, can be the following materials.

The adhesive layers in the coated abrasive articles of the present invention used variously as make, size and supersize coats, typically are formed from a resinous adhesive. Each of the layers can be formed from the same or different resinous adhesives. Useful resinous adhesives are those that are compatible with the organic polymeric binder material of the backing. Cured resinous adhesives are also tolerant of grinding conditions such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, or mixtures thereof.

Preferably, the thermosetting resin adhesive layers contain a phenolic resin, an aminoplast resin, or combinations thereof. The phenolic resin is preferably a resole phenolic resin. Examples of commercially available phenolic resins include "VARCUM" from OXY Chem Corporation, Dallas, Tex.; "AROFENE" from Ashland Chemical Company, Columbus, Ohio; and "BAKELITE" from Union Carbide, Danbury, Conn. A preferred aminoplast resin is one having at least one pendant alpha, beta-unsaturated carbonyl groups per molecule, which is made according to the disclosure of U.S. Pat. Nos. 4,903,440 (Larson et al.) or 5,236,472 (Kirk et al.), which is incorporated herein by reference.

The make and size coats, layers 27 and 29 respectively in FIG. 2, can preferably contain other materials that are commonly utilized in abrasive articles. These materials, referred to as additives, include grinding aids, fillers, coupling agents, wetting agents, dyes, pigments, plasticizers, release agents, or combinations thereof. One would not typically use more of these materials than needed for desired results. Fillers are typically present in no more than an amount of about 90 wt%, for either the make or size coat, based upon the weight of the adhesive. Examples of useful fillers include calcium salts, such as calcium carbonate and calcium metasilicate, silica, metals, carbon, or glass.

Preferably, the adhesive layers, at least the make and size coat, the second and third adhesive layers, respectively, are formed from a calcium metasilicate filled resin treated with a silane coupling agent, such as resole phenolic resin, for example. Resole phenolic resins are preferred at least because of their heat tolerance, toughness, high hardness, and low cost. More preferably, the adhesive layers include about 50-90 wt% silane treated calcium metasilicate in a resole phenolic resin.

Abrasive Particles

The abrasive particles suitable for this invention include fused aluminum oxide, heat treated aluminum oxide, ceramic aluminum oxide, silicon carbide, alumina zirconia, garnet, diamond, cubic boron nitride, titanium diboride, or mixtures thereof. The abrasive particles can be either shaped (e.g., rod, triangle, or pyramid) or unshaped (i.e., irregular). The term "abrasive particle" encompasses abrasive grains, agglomerates, or multi-grain abrasive granules. Examples of such agglomerates are described in U.S. Pat. No. 4,652,275 (Bloecher et al.) and U.S. application Ser. No. 08/316,259 (Christianson) filed 30 Sep. 1994 and assigned to the assignee of the present invention. The agglomerates can be irregularly shaped or have a precise shape associated with them, for example, a cube, pyramid, truncated pyramid, or a sphere. An agglomerate comprises abrasive particles or grains and a bonding agent. The bonding agent can be organic or inorganic. Examples of organic binders include phenolic resins, urea-formaldehyde resins, and epoxy resins. Example of inorganic binders include metals (such as nickel), and metal oxides. Metal oxides are usually classified as either a glass (vitrified), ceramic (crystalline), or glass-ceramic. Further information on ceramic agglomerates is disclosed in U.S. application Ser. No. 08/316,259 (Christianson) filed 30 Sep. 1994, assigned to the assignee of the present invention.

Useful aluminum oxide grains for applications of the present invention include fused aluminum oxides, heat treated aluminum oxides, and ceramic aluminum oxides. Examples of such ceramic aluminum oxides are disclosed in U.S. Pat. Nos. 4,314,827 (Leitheiser et al.), 4,744,802 (Schwabel), 4,770,671 (Monroe et al.), and 4,881,951 (Wood et al.).

The average particle size of the abrasive particle for advantageous applications of the present invention is at least about 0.1 micrometers, preferably at least about 100 micrometers. A grain size of about 100 micrometers corresponds approximately to a coated abrasive grade 120 abrasive grain, according to American National Standards Institute (ANSI) Standard B74.18-1984. The abrasive grain can be oriented, or it can be applied to the backing without orientation, depending upon the desired end use of the coated abrasive backing.

The abrasive particles can be embedded into the make coat precursor by any conventional technique such as electrostatic coating, drop coating, or magnetic coating. During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor. Magnetic coating involves using magnetic forces to coat the abrasive particles.

If the abrasive particles are applied by electrostatic coating, then it is preferred that the backing be placed on a drum. This drum can be the original support structure or a different drum. The drum serves as a ground for the electrostatic coating process. The proper amount of abrasive particles is then placed on a plate underneath the drum. Next, the drum is rotated and the electrostatic field is turned on. As the drum rotates, the abrasive particles are embedded into the make coat. The drum is rotated until the desired amount of abrasive particles is coated. The resulting construction is exposed to conditions sufficient to solidify the make coat.

Alternately, a charged plate can be used as the ground for the electrostateic process instead of the drum. Size Coat A size coat, or third adhesive layer, may be applied over the abrasive particles and the make coat such as by roll coating or spray coating. The preferred size coat is a resole phenolic resin filled with a silane treated calcium metasilicate. After the size coat is applied, the size coat is solidified, typically upon exposure to an energy source. These energy sources include both thermal and radiation energy.

Supersize Coat

In some instances it may be preferred to apply a supersize coat, or fourth adhesive layer, over the size coat. The optional supersize coat can preferably include a grinding aid, to enhance the abrading characteristics of the coated abrasive. Examples of grinding aids include potassium tetrafluoroborate, cryolite, ammonium cryolite, or sulfur. One would not typically use more of a grinding aid than needed for desired results. The supersize coat may comprise a binder and a grinding aid.

The abrasive material can also be applied using a preformed abrasive coated laminate. This laminate consists of a substrate of material coated with abrasive grains. The substrate of material can be a piece of cloth, polymeric film, vulcanized fiber paper, and the like. The laminate can be applied to the outer surface of the backing of the present invention using; any of the adhesives discussed above; thermobonding; a pressure sensitive adhesive; or mechanical fastening means, such as a hook and loop means, such as disclosed, for example, in U.S. Pat. No. 4,609,581 (Ott). This could include a method of attachment by which the laminate is applied to a liquid loop of backing binder and reinforcing fiber such that the laminate is attached by curing or solidifying the liquid backing loop. This embodiment of the coated abrasive article of the present invention is advantageous at least because of the potential for removing the laminate once the abrasive material is exhausted and replacing it with another such laminate. In this way the backing of the present invention can be recycled and reused.

The following non-limiting examples will further illustrate the invention. All parts, percentages, ratios, etc., in the examples are by weight unless otherwise indicated.

EXAMPLES

The following designations are used throughout the examples.

DW: deionized water;

SCA: silane coupling agent, commercially available from OSi Specialties (Danbury, Conn.)under the trade designation "A-1100";

ASC: amorphous silica clay, commercially available from DeGussa GMBH (Germany) under the trade designation "Peerless #4";

RPR: resole phenolic resin, containing between 0.75 to 1.4% free formaldehyde and 6 to 8% free phenol, percent solids about 78% with the remainder being water, pH about 8.5, and viscosity between about 2400 and 2800 centipoise;

ASF: amorphous silica filler, commercially available from DeGussa GMBH (Germany) under the trade designation "Aerosil R-972"; HLR: latex resin, commercially available from B. F.

Goodrich (Cleveland, Ohio) under the trade designation "Hycar 1581";

SWA1: wetting agent, commercially available from Akzo Chemie America (Chicago, Ill.) under the trade designation "Interwet 33";

SWA2: wetting agent, commercially available from Union Carbide Corp. (Danbury, Conn.) under the trade designation "Silwet L-7604";

ERH: epoxy resin, commercially available from Shell Chemical Co. (Houston, Tex.) under the trade designation "Epon 828";

POPDA: polyoxypropylenediamine commercially available from Huntsman Corp. (Salt Lake City, Utah) under the trade designation "Jeffamine D-230";

UR1: a polyether based polyurethane resin commercially available from Uniroyal Chemical Corp. (Middlebury, Conn.) under the trade designation "Adiprene L-167";

DMTA: di(methylthio)toluenediamine commercially available from Albemarle Corporation (Baton Rouge, La.) under the trade designation "Ethacure 300";

TPGA: tripropyleneglycoldiacrylate commercially available from Sartomer (West Chester, Pa) under the trade designation "SR-306";

PH2: 2-benzyl-2-N,N-dimethylamino-1-(4-morpholinophenyl)-1-butanone, commercially available from Ciba Geigy Corp. (Hawthorn, NY) under the trade designation "Irgacure 369";

CMSK: calcium metasilicate, commercially available from NYCO (Willsboro, N.Y.) under the trade designation "400 Wollastokup";

IO: iron oxide pigment, commercially available from Harcros Pigments, Inc. (Fairview Heights, Ill.) under the trade designation "Kroma Red Iron Oxide";

GBF: glass bubbles, commercially available from Minnesota Mining and Manufacturing Co. (St.

Paul, Minn.) under the trade designation "Scotchlite H50/10,000 EPX".

EXAMPLE 1

An endless spliceless polyester/cotton backing substrate available from Advanced Belt Technology (Middletown, Conn.) under the designation "WT-3", was provided. The weave was a 2 cotton over 1 polyester weave, with cotton in the warp (machine) direction and polyester in the weft (fill) direction. The polyester was about 11 threads/cm, and the cotton was about 45 threads/cm. The polyester was in belt circumference and the cotton was in the cross direction. The length of the spliceless backing was 335.3 cm (132 inches) and the width was 30.5 cm (12 inches).

The spliceless backing loop substrate was rinsed in tap water and placed over an aluminum hub which had a circumference of 335.3 cm, a width of 38.1 cm, and a wall thickness of 0.64 cm. The hub was installed on a 7.6 cm mandrel that rotated by a DC motor and was capable of rotating from 1 to 45 revolutions per minute (rpms).

A backing saturant was applied to the spliceless backing once it was on the hub. A layer of resin, having the following formulation, was coated onto the spliceless backing loop substrate: 25 parts DW, 0.5 part SCA, 14parts ASC, 21.5 parts RPR, 2.5 parts ASF, 36 parts HLR, 0.25 part SWA1, and 0.25 part SWA2. The viscosity of this saturant resin was 310 cps when measured at 34° C. with a Brookfield Viscometer, spindle 2, at 60 rpm. The wet weight of the saturant coating was approximately 0.0325 gram per square cm (0.21 gram per inch) and soaked approximately half the thickness of the backing loop. After coating, the drum was rotated at 3 rpm and the saturant coating was dried and partially cured using infrared heaters.

An epoxy resin coating, referred to as a "pre-size", having the following formulation, was coated onto the saturated spliceless backing: 73 parts ERH, 24.35 parts POPDA, 2.4 parts ASF, and 0.25 part SWA2. The wet weight of this epoxy coating was approximately 0.009 gram per square cm (0.06 gram per square inch). After coating, the drum was rotated at 3 rpm and the coating was partially cured using the infrared heaters as above.

A urethane resin formulation, known as the "winding" resin, having the following formulation, was coated onto the cured pre-size coating to form a "base layer": 50 parts UR1, 23 parts DMTA, 26 parts TPGA, 0.5 part PH2, and 0.5 part SWA2. The wet weight of this coating was approximately 0.0325 gram per square cm (0.21 gram per square inch). After coating, a doctor blade was used to smooth the winding resin. The smoothed resin then cured for 60 seconds with a (600 watt/inch) "V" bulb from Fusion Systems.

A second layer of winding resin was coated ontop of the cured base layer, by the methods described above. After smoothing, 800 denier "KEVLAR 49" fiber available from Synthetic Thread Co. Inc., Bethlehem, Pa, was wound onto and into the smoothed resin at about 16.5 threads per cm (42 threads per inch) of belt width. The fibers were essentially engulfed by the resin. The "KEVLAR" fibers strengthen the final backing and minimize stretch. The strands were first run through a tensioner and then wound through a comb, two at a time. The reinforcing fibrous strands were wrapped over the spliceless backing loop substrate by means of a yarn guide system with a level winder that moved across the face of the hub at a rate of 10 cm per minute. During this process, the hub rotated at 45 rpm. After wrapping, the resin and fibers were smoothed with a doctor blade, and cured for 60 seconds with the same "V" lamp.

Another layer of winding resin was coated at the same resin weight directly ontop of the previously cured resin. This was then cured for 60 seconds with the same "V" bulb.

The fiber reinforced backing structure was removed from the hub and turned inside out, i.e. everted, so that the reinforcing fibers were located on the inside of the loop.

EXAMPLE 2

Example 2 was prepared in the same manner as Example 1, except that after the layers of winding resin were coated and cured, approximately 0.12–0.25 mm (5–10 mils) of cured resin was ground off with a Doall D-10 grinder (The Doall Company, Des Plaines, Ill.) using 180 micron Imperial Microfinishing Film (from Minnesota Mining and Manufacturing Co.). This act of grinding the back aided in smoothing the backing further and providing an even caliper.

EXAMPLE 3

Example 3 was prepared in the same manner as Example 1, except that after applying and smoothing the second layer of winding resin, a third layer of winding resin was coated and smoothed. A second layer of fiber was wound into and onto the smoothed resin. The resin was cured, and a fourth layer of resin was coated and cured. The resulting belt was everted.

EXAMPLE 4

Example 4 was prepared in the same manner as Example 3, except that after the final cure, the belt was removed from the hub, and slit to 7.62 cm (3 inches). These slit strips were moved to a mandrel (reinforcing fibers out), and approximately 0.12–0.25 mm (5–10 mils) of cured resin was ground off with a Doall D-10 grinder using 180 micron Imperial Microfinishing Film (from Minnesota Mining and Manufacturing Co.). This act of grinding the back aided in smoothing the backing further and providing an even caliper.

The following designations are used throughout the examples, particularly for the making of the abrasive agglomerates.

SAG: cubic boron nitride grain, 140/170 mesh; ERH: epoxy resin, commercially available from Shell Chemical Co. (Houston, Tex.) under the trade designation "Epon 828"; p0 DW: deionized water; p0 EGME: ethylene glycol monobutyl ether, also known as polysolve, commercially available from Olin Company (Stamford, Conn.);

PS100: aromatic solvent, commercially available from Exxon Chemical Co. (Houston, Tex.) under the trade designations "WC-100";

EPH: epoxy hardener, commercially available from Henkel Corporation (Minneapolis, Minn.) under the trade designation "Versamid 125";

GPM: glass powder, $SiO_2$ 51.5%, $B_2O_2$27.0%, $A1_2O_3$ 8.7%, MgO 7.5%, ZnO 2.0%, CaO 1.1%, $Na_2O$ 1.0%, $K_2O$ 1.0%, $Li_2O$ 0.5%, ground to finer than 325 mesh.

EXAMPLE 5

Example 5 was a coated abrasive belt made using the backing of Example 1 which had been slit to 7.6 cm (3 inches).

The fiber reinforced backing structure, Example 1, was turned inside out, i.e., everted, so that the reinforcing fibers were on the inside, and placed under tension on a pair of idler rolls with one roll drivable by motor to rotate the backing. All resin coatings were on the polyester/cotton side of the backing.

A saturant resin, having the following formulation, was roll coated on the exposed side of spliceless backing substrate opposite the fiber reinforcing layer: 31.6 parts DW, 0.4 part SCA, 13.3 parts ASC, 20 parts RPR, 1.8 parts ASF, 32.4 parts HLR, 0.25 part SWAL, and 0.25 part SWA2. The wet weight of this saturant coating was approximately 0.019 grams per square cm (0.12 gram per square inch). The saturated backing was placed on a round hub and dried in an oven for 30 minutes at 90° C.

An epoxy pre-size resin, having the following formulation, was knife coated onto the dried backing: 73 parts ERH, 24.35 parts POPDA, 2.4 parts ASF, and 0.25 part SWA2. The wet weight of this size coating was approximately 0.011 grams per square cm (0.07 gram per square inch). The coated backing was placed on a round hub and cured in an oven for 30 minutes at 90° C.

A phenolic make resin, having the following formulation, was knife coated in a 5.7 cm (2.25 inch) wide path on the 7.6 cm (3 inch) wide backing: 34.29 parts RPR, 12.46 parts DW, 51.85 parts CMSK, 0.75 part ASF, 0.19 part ASC, 0.23 part SWAL, and 0.23 part SWA2. The knife setting (gap) was set at 0.3 mm (0.013 inch).

Vitrified agglomerates were prepared according to the method described below. A glass binder, GPM, was formulated so that its coefficient of thermal expansion was approximately the same as the coefficient of thermal expansion of the superabrasive grains used in the examples ($3.5\times10^{-6}$/° C.).

Vitrified agglomerates were formed by mixing the following formulation to form a slurry: 47.2 parts SAG, 17.7 parts GP, 6.8 parts ERH, 3 parts ERH, 3 parts PS100, and 22.3 parts 85/15 EGME/DW. The slurry was knife coated into a silicone mold with holes approximate 1016 micrometers deep, long, and wide (0.040 inch). The slurry was dried and cured in the mold at 90° C. for 30 minutes. The resulting cubes were removed from the mold. To prevent the agglomerates from sticking together during the firing process, the dried agglomerates were placed in a bed of 220/230 mesh SAG in an alumina sagger. The sagger was placed in a small furnace that was open to the air. The furnace temperature was increased from 25° C. to 900° C. over a four hour period, after which it was held at 900° C. for 3 hours, and then turned off and allowed to cool to room temperature overnight. The fired, vitrified agglomerates were screened through a 16 mesh screen to separate them from each other and also remove any fine SAG.

The vitrified agglomerates, prepared above, were drop coated at a weight of 0.093 gram per square cm (0.60 gram per square inch) onto and into the phenolic make resin described above. The belts were placed on a nearly circular hub and in an oven at 90° C. for 90 minutes and at 155° C. for 30 minutes.

A phenolic size resin, having the following formulation, was roll coated onto the agglomerates: 30.06 parts RPR, 28.48 parts DW, 0.37 part SCA, 37.34 parts CMSK, 0.19 part IO, 1.21 parts GBF, 0.23 part SWA1, and 0.23 part SWA2. The wet weight of the size coat was approximately 0.033 grams per square cm (0.21 gram per square inch). The belts were placed in an oven at 90° C. for 90 minutes, 105° C. for 10 hours, and at 130° C. for 3 hours.

EXAMPLE 6

Example 6 was prepared in the same manner as Example 5, except the backing used was that of Example 4.

The invention has been described with reference to various specific and preferred embodiments and techniques. It should be understood, however, that many variations and modifications can be made while remaining within the spirit and scope of the invention.

What is claimed is:

1. A method of making a flexible coated abrasive belt comprising the steps of:

(a) mounting an endless, spliceless backing loop substrate having an exposed front surface and a back surface tautly on a peripheral surface of a temporary support structure;

(b) applying a continuous metallic fibrous reinforcing material onto said front surface in a plurality of revolutions;

(c) applying a coating of a first binder precursor onto said front surface;

(d) exposing said coating to conditions effective to solidify said first binder precursor and bond said fibrous reinforcing material to said front surface to form an endless spliceless reinforced backing; and (e) applying an abrasive coating comprising abrasive particles and adhesive over said; back surface or said front surface of said endless spliceless reinforced backing.

2. The method of claim 1,wherein said continuous fibrous reinforcing material is a strand.

3. The method of claim 2, wherein said fibrous reinforcing material is applied by helically winding said fibrous strand onto said front surface.

4. The method of claim 3, wherein said fibrous reinforcing strand is wound with a strand spacing of about 2 to 50 strands per cm of lateral width of said front surface.

5. The method of claim 3, wherein said helically wound strand substantially covers the entire lateral width of said front surface.

6. The method of claim 1, wherein said endless spliceless backing loop substrate is selected from the group consisting of woven cloth, knitted cloth, paper, nonwoven mat, vulcanized fiber sheet, primed and unprimed polymeric film, treated versions thereof, and combinations thereof.

7. The method of claim 1, wherein said endless spliceless backing loop is selected from the group consisting of cotton, polyester, and combinations thereof.

8. The method of claim 1, wherein said temporary support structure is a cylinder.

9. The method of claim 1, wherein step (c) is conducted before step (b).

10. The method of claim 1, wherein step (e) is conducted before step (a).

11. A method of making a flexible coated abrasive belt comprising the steps of:

(a) mounting an endless, spliceless backing loop substrate having an exposed front surface and a back surface tautly on a peripheral surface of a temporary support structure;

(b) at least partially saturating said substrate with a saturant resin precursor;

(c) at least partially curing said saturant resin precursor;

(d) applying a coating of a pre-size precursor onto said front surface;

(e) at least partially curing said pre-size precursor;

(f) applying a continuous metallic fibrous reinforcing material onto said front surface in a plurality of revolutions;

(g) applying a coating of a first binder precursor onto said front surface;

(h) exposing said coating to conditions effective to solidify said first binder precursor and bond said fibrous reinforcing material to said front surface to form an endless spliceless reinforced backing; and (i) applying an abrasive coating comprising abrasive particles and adhesive over said back surface or said front surface of said endless spliceless reinforced backing.

12. The method of claim 11, wherein said loop substrate is cloth.

13. The method of claim 11, wherein said continuous fibrous reinforcing material is a strand.

14. The method of claim 11, where in said fibrous reinforcing material is applied by helically winding said fibrous strand onto said front surface.

15. The method of claim 14, wherein said fibrous reinforcing strand is wound with a strand spacing of about 2 to 50 strands per cm of lateral width of said front surface.

16. The method of claim 14, wherein said helically wound strand substantially covers the entire lateral width of said front surface.

17. A method of making a flexible coated abrasive belt comprising the steps of:

(a) mounting an endless, spliceless backing loop substrate having an exposed front surface and back surface tautly on a peripheral surface of a temporary support structure;

(b) at least partially saturating said substrate with a saturant resin precursor;

(c) at least partially curing said saturant resin precursor;

(d) applying a coating of a pre-size precursor onto said front surface;

(e) at least partially curing said pre-size precursor;

(f) applying a fibrous reinforcing layer comprising continuous metallic fibrous reinforcing material and binder material onto said front surface in a plurality of revolutions;

(g) applying an abrasive coating comprising abrasive particles and adhesive over said back surface or said front surface of said endless spliceless reinforc e d backing.

18. The method of claim 1 further comprising a step of pretreating said continuous metallic fibrous reinforcing material prior to applying said pretreated continuous metallic fibrous reinforcing material onto the front surface of the backing loop.

19. The method of claim 18 wherein said step of pretreating comprises pretreating with an adhesion promoter.

20. The method of claim 18 further comprising a step of applying a coupling agent to at least a portion of said pretreated continuous metallic fibrous reinforcing material.

21. The method of claim 20 wherein said coupling agent is a silane coupling agent.

22. The method of claim 1 further comprising a step of applying a coupling agent to at least a portion of said continuous metallic fibrous reinforcing material.

23. The method of claim 22 wherein said coupling agent is a silane coupling agent.

24. The method of claim 11 further comprising a step of pretreating said continuous metallic fibrous reinforcing material prior to applying said pretreated continuous metallic fibrous reinforcing material onto the front surface of the backing loop.

25. The method of claim 24 wherein said step of pretreating comprises pretreating with an adhesion promoter.

26. The method of claim 25 further comprising a step of applying a coupling agent to at least a portion of said pretreated continuous metallic fibrous reinforcing material.

27. The method of claim 24 wherein said coupling agent is a silane coupling agent.

28. The method of claim 11 further comprising a step of applying a coupling agent to at least a portion of said continuous metallic fibrous reinforcing material.

29. The method of claim 17 wherein said continuous metallic fibrous reinforcing material is pretreated with an adhesion promoter.

30. The method of claim 29 wherein at least a portion of said pretreated continuous metallic fibrous reinforcing material is coated with a coupling agent.

31. The method of claim 30 wherein said coupling agent is a silane coupling agent.

32. The method of claim 17 wherein at least a portion of said continuous metallic fibrous reinforcing material is coated with a coupling agent.

33. The method of claim 32 wherein said coupling agent is a silane coupling agent.

* * * * *